US005663862A

United States Patent [19]

Hopping-Mills

[11] Patent Number: 5,663,862

[45] Date of Patent: Sep. 2, 1997

[54] ENCLOSURE FOR A CIRCUIT BREAKER

[75] Inventor: Otto Owen Hopping-Mills, Pretoria, South Africa

[73] Assignee: Reutech Commercial Electronics (Proprietary) Limited, Boksburg, South Africa

[21] Appl. No.: 521,999

[22] Filed: Aug. 31, 1995

[30] Foreign Application Priority Data

Aug. 31, 1994 [ZA] South Africa ..... 94/6655

[51] Int. Cl.[6] ..... H01H 9/28

[52] U.S. Cl. ..... 361/115; 361/616; 361/654; 361/726; 361/747; 361/672; 200/43.15

[58] Field of Search ..... 361/115, 615–616, 361/631–632, 654, 726–727, 641, 667, 672, 747; 200/43.14, 43.15, 43.22, 50.01, 50.11

[56] References Cited

U.S. PATENT DOCUMENTS

| | | | |
|---|---|---|---|
| 1,412,242 | 4/1922 | Horton | 361/616 |
| 3,591,835 | 7/1971 | Sloop | 361/672 |
| 4,006,324 | 2/1977 | Leasher et al. | 200/42 T |

*Primary Examiner*—Jeffrey A. Gaffin
*Assistant Examiner*—Michael J. Sherry
*Attorney, Agent, or Firm*—Felfe & Lynch

[57] ABSTRACT

An enclosure for a circuit breaker includes a housing sized to support at least one circuit breaker and to permit electrical connections to be made to the circuit breaker. A housing cover or lid is movable between an open position in which the circuit breaker is accessible and a closed position in which access to the electrical connections of the circuit breaker is prevented. An actuating bar is mounted slidably to the lid, and includes a switch-engaging formation for engaging the operating lever of the circuit breaker. The actuating bar includes a switch-engaging formation for engaging the operating lever of the circuit breaker and is operable to move the operating lever between the first, active position and a second, inactive position. An interlocking formation in the form of a waisted portion defined in the bar is adapted to prevent opening of the cover when the switch operating lever is in the first position and to allow opening of the cover when the operating lever is in the second position. The interlocking formation is slidable to engage a corresponding interlocking formation in the form of a slot defined in the housing. The waisted portion is dimensioned and positioned to allow the bar to be freed from the slot when the bar is slid to move the operating lever to the second inactive position.

7 Claims, 1 Drawing Sheet

ENCLOSURE FOR A CIRCUIT BREAKER

BACKGROUND TO THE INVENTION

This invention relates to an enclosure for a switch such as a circuit breaker.

In the underground mining environment, the electrical equipment and machinery, such as winch starters and the like, is fitted with individual circuit breakers. The circuit breakers are enclosed in a rugged housing which protects all but the operating levers of the circuit breakers. As a result, the operating levers can be tampered with or vandalised, especially when not manually locked in position. Apart from the associated safety hazards, this may also lead to considerable down time while mine electricians repair the damaged levers.

SUMMARY OF THE INVENTION

According to the invention an enclosure for an electrical switch comprises:

- a housing sized to support at least on switch and to permit electrical connections to be made thereto;
- a housing cover moveable between an open position in which the switch is accessible and a closed position in which access to the electrical connections of the switch is prevented; and
- an actuating member associated with one of the cover and the housing and adapted to engage an operating lever of the switch when the cover is in its closed position, the actuating member being operable to move the switch operating lever between a first active position and a second inactive position, and having an interlocking formation thereon adapted to prevent opening of the cover when the switch operating lever is in the first position and to allow opening of the cover when the operating lever is in the second position.

Preferably, the actuating member comprises an actuating bar which is mounted slidably to the cover, the bar including a switch-engaging formation for engaging the operating lever of the switch, the interlocking formation being slidable to engage a corresponding interlocking formation on the housing.

Conveniently, the interlocking formation includes a waisted portion defined in the bar and the corresponding interlocking formation comprise a slot defined in the housing within which the bar is held captive when the housing cover is in the closed position and the operating lever is in the first active position, the waisted portion being dimensioned and positioned to allow the bar to be freed from the slot when the bar is slid to move the operating lever to the second inactive position.

Typically, the slot is T-shaped in form, having a narrowed opening portion for permitting passage of the waisted portion of the bar.

Advantageously, locking formations are provided on both the bar and the housing, for allowing the cover to be manually locked to the housing when the operating lever is in the second inactive position.

The actuating bar may be slidably mounted to an inner surface of the cover by means of at least one locating pin extending from the cover and passing through a corresponding slot formed in the bar, the locating pin having an expanded head for holding the bar captive.

Conveniently, the switch-engaging formation comprises an aperture through which the operating lever is arranged to pass, with opposite edges of the aperture being arranged to act on the operating lever of the switch on movement of the actuating bar.

Typically, the switch is a circuit breaker having a circuit breaker operating lever, and the enclosure is a circuit breaker housing, with the first, active position of the circuit breaker operating lever corresponding to an "on" condition of the circuit breaker, and the second, inactive position of the lever corresponding to an "off" condition thereof.

The invention extends to a plurality of enclosures for electrical switches of the type described above, the enclosures being arranged side-by-side, with the respective actuating bars of each enclosure being interlocked so that none of the enclosures can be opened if any one of the switches is on.

DESCRIPTION OF AN EMBODIMENT

Figure 1:
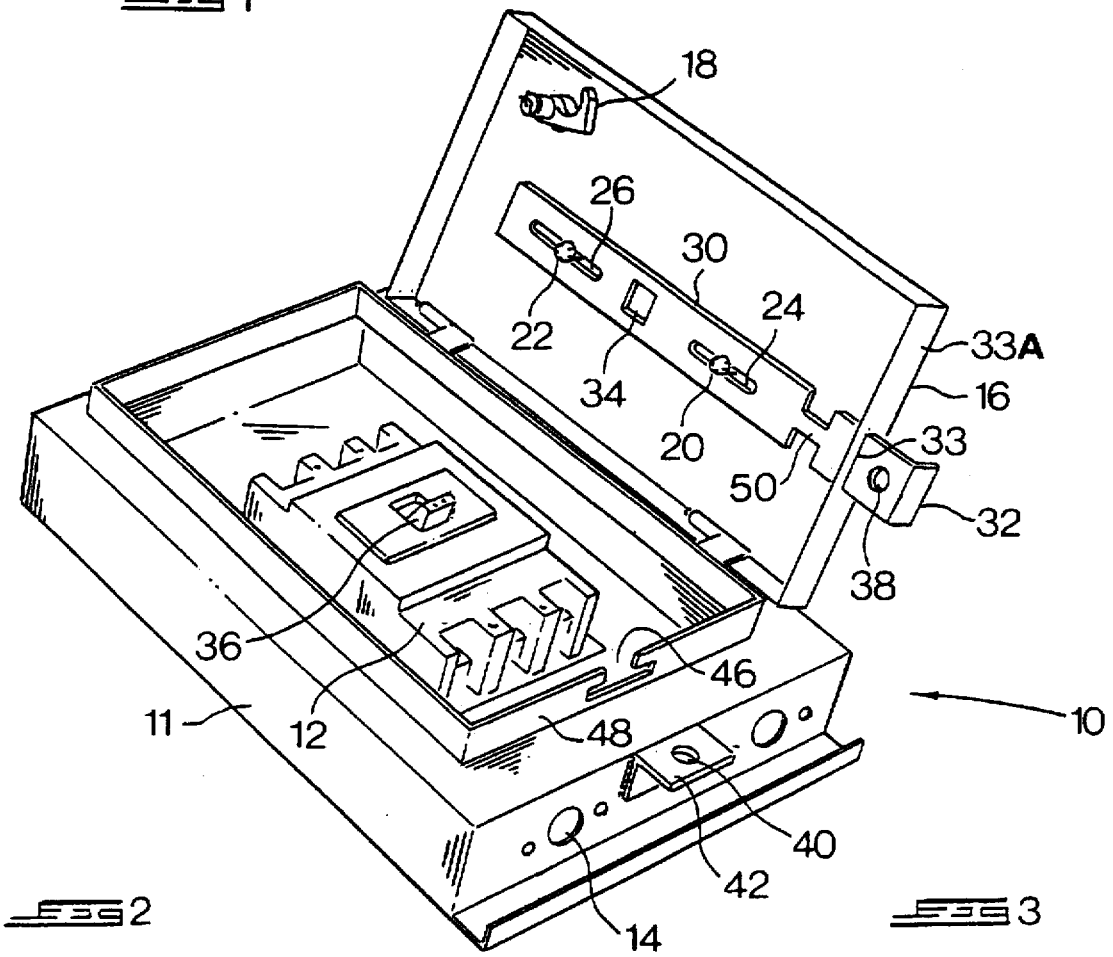
FIG. 1 is a pictorial view of an enclosure for a circuit breaker according to the invention with its cover open.

The illustrated enclosure 10 for a circuit breaker is generally rectangular in plan and comprises a housing 11 which can be fabricated from sheet metal or moulded from a suitable plastics material. The interior of the housing is sufficiently large to accommodate a three phase circuit breaker 12 with sufficient room to permit electrical connections to be made to the line and load sides of the circuit breaker. Aperture 14 on the bottom edge of the housing allow the fitting of cable glands through which shielded conductors are fed into and out of the housing.

Hinged to the housing is a cover 16 which can be secured by means of a catch 18. A pair of headed locating pins 20 and 22 are mounted to the cover 16, and pass through respective slots 24 and 26 in an actuating bar 30 so as to support it slidably against the inner surface of the cover 16. An L-shaped tab 32 extends from the actuating bar beyond the lower edge of the cover 16 through a complemental rectangular slot 33 in a lower flange 33A of the cover. An aperture 34 located between the slots 24 and 26 in the bar is sized to receive the end of the operating lever 36 of the circuit breaker 12, so that longitudinal movement of the bar 30 moves the circuit breaker operating lever between its "on" and "off" positions.

Figure 2:
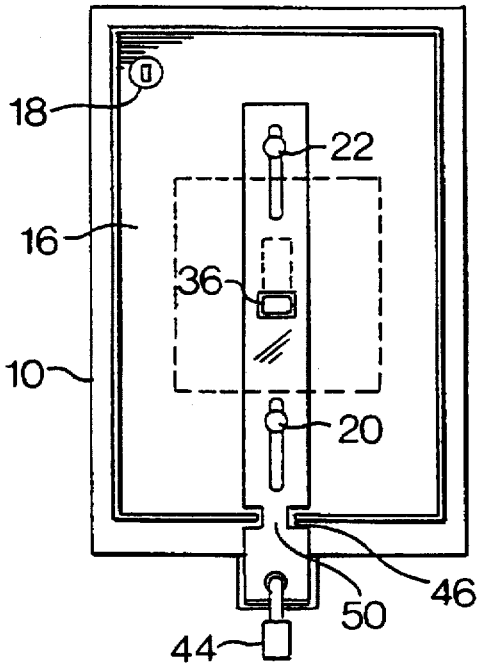
FIGS. 2 & 3 are plan views of the enclosure, showing an operating lever thereof in two different positions.

The tab 32 of the actuating bar 30 has an aperture 38 formed therein, which is aligned with an aperture 40 in a corresponding tab 42 on the housing 10 when the circuit breaker operating lever is in its off position. This condition is shown in FIG. 2. With the actuating bar in this position, a padlock 44 can be passed through the aligned apertures 38 and 40, for locking the circuit breaker in its off position. For increased safety, additional apertures may be provided for allowing the passage of additional padlocks. In the illustrated embodiment, the actuating bar is in the form of a uniplanar strip. In order to increase its rigidity, it may be formed with upstanding edges so as to define a U-shaped profile.

Figure 3:
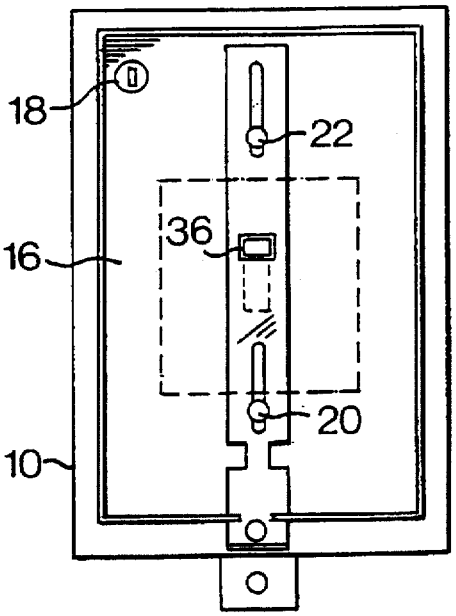

When the actuating bar 30 is moved upwardly (see FIG. 3) to move the circuit breaker operating lever to its "on" position, the actuating bar 30 is captive in a T-shaped slot 46 formed in the upstanding inner edge 48 of the housing 10, which prevents opening of the cover 16 while the circuit breaker is on. However, when the circuit breaker is off, a waisted portion 50 of the actuating bar is aligned with the inner edges of the slot 46 (see FIG. 2) thus allowing the enclosure to be opened only when the circuit breaker is off.

The invention can be applied to a plurality of circuit breaker enclosures arranged side-by-side, with the respective actuating bars of each enclosure being interlocked so that none of the enclosures can be opened if any one of the circuit breakers is on.

An advantage of the invention is that the operating lever cannot be directly accessed when in the "on" position, and can only be accessed in the "off" position when the padlock is removed. As a result, the potential for vandalism is reduced, and overall operating safety is considerably enhanced.

I claim:

1. An enclosure for an electrical switch comprising:

a housing sized to support at least one switch and to permit electrical connections to be made thereto;

a housing cover moveable between an open position in which the switch is accessible and a closed position in which access to the electrical connections of the switch is prevented; and an actuating member which comprises an actuating bar which is mounted slidably to the housing cover, the bar including a switch-engaging formation engaging an operating lever of the switch when the cover is in the closed position, the actuating bar being operable to move the switch operating lever between a first active position and a second inactive position, and having an interlocking formation thereon being slidable to engage a corresponding interlocking formation on the housing to prevent opening of the cover when the switch operating lever is in the first position and to allow opening of the cover when the operating lever is in the second position.

2. An enclosure according to claim 1 in which the interlocking formation includes a waisted portion defined in the bar and the housing defining a slot therein within which the bar is held captive when the housing cover is in the closed position and the operating lever is in the first active position, the waisted portion being dimensioned and positioned to allow the bar to be freed from the slot when the bar is slid to move the operating lever to the second inactive position.

3. An enclosure according to claim 2 in which the slot is T-shaped in form, having a narrowed opening position for permitting passage of the waisted portion of the bar.

4. An enclosure according to claim 1 wherein locking formations are provided on both the bar and the housing, for allowing the cover to be manually locked to the housing when the operating lever is in the second inactive position.

5. An enclosure according to claim 1 wherein the actuating bar has at least one slot therein, and the actuating bar is slidably mounted to an inner surface of the cover by means of at least one locating pin extending from the cover and passing through a corresponding slot formed in the bar, the locating pin having an expanded head for holding the bar captive.

6. An enclosure according to claim 1 in which the switch-engaging formation having edges defining an aperture therein through which the operating lever is arranged to pass, with opposite edges of the aperture being arranged to act on the operating lever of the switch on movement of the actuating bar.

7. An enclosure according to claim 1 in which the switch is a circuit breaker having a circuit breaker operating lever, and the enclosure is a circuit breaker housing, with the first, active position of the circuit breaker operating lever corresponding to an "on" condition of the circuit breaker, and the second, inactive position of the lever corresponding to an "off" condition thereof.

* * * * *